US007270281B2

(12) United States Patent
Greenwald et al.

(10) Patent No.: US 7,270,281 B2
(45) Date of Patent: Sep. 18, 2007

(54) HIGH FREQUENCY ELECTRO MECHANICAL PILL/TABLET DISSOLVER

(76) Inventors: Shlomo Greenwald, 113 Randolph Rd., Ithaca, NY (US) 14850; Zipora Greenwald, 113 Randolph Rd., Ithaca, NY (US) 14850

( * ) Notice: Subject to any disclaimer, the term of this patent is extended or adjusted under 35 U.S.C. 154(b) by 151 days.

(21) Appl. No.: 11/257,352

(22) Filed: Oct. 24, 2005

(65) Prior Publication Data

US 2006/0091246 A1 May 4, 2006

Related U.S. Application Data

(60) Provisional application No. 60/623,806, filed on Oct. 29, 2004.

(51) Int. Cl.
*B02C 19/00* (2006.01)

(52) U.S. Cl. ..... 241/21; 241/62; 241/262; 241/DIG. 27

(58) Field of Classification Search ..... 241/187, 241/21, 60, 62, DIG. 27, 262; 604/82
See application file for complete search history.

(56) References Cited

U.S. PATENT DOCUMENTS

| | | | | |
|---|---|---|---|---|
| 5,067,666 | A | 11/1991 | Sussman | 241/36 |
| 5,376,072 | A | 12/1994 | Klearman et al. | 604/82 |
| 5,531,386 | A | 7/1996 | Jensen | 241/36 |
| 6,622,949 | B1 | 9/2003 | Baswick et al. | 241/36 |

*Primary Examiner*—Mark Rosenbaum
(74) *Attorney, Agent, or Firm*—Brown & Michaels, PC

(57) ABSTRACT

A pill dissolver includes a first crushing surface, and a second crushing surface positioned to receive a cup between the first crushing surface and the second crushing surface. The pill dissolver also includes pinching jaws operable to pinch a top portion of the cup above the first and second crushing surfaces. The pill dissolver further includes an actuator which creates relative movement and an impact force between the first crushing surface and the second crushing surface. A method of dissolving a pill and a pill dissolving system are also described.

31 Claims, 7 Drawing Sheets

HIGH FREQUENCY ELECTRO MECHANICAL PILL/TABLET DISSOLVER

REFERENCE TO RELATED APPLICATIONS

This application claims an invention which was disclosed in Provisional Application No. 60/623,806, filed Oct. 29, 2004, entitled "High Frequency Electro Mechanical Pill/Tablet Dissolver." The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of apparatus for preparation of medicines. More particularly, the invention pertains to methods and apparatus for crushing and dissolving pills and tablets 2. Description of Related Art Young children and old people often have difficulties swallowing solid medications. In some institutional settings such as prisons, regulations prevent distribution of medicines in solid form. Therefore, there is a need for disintegrating and dissolving solid medicine or solid-encased liquid-filled medicines (pills, caplets, liquid-gels, and tablets-hereinafter "p/t") so that the medicine can be administered in liquid form.

Pill/tablet dissolvers are used in hospitals to help administer solid medication to people who have difficulties in swallowing solid medication. These devices are also used in nursing homes and correctional facilities.

Many prior art manual dissolvers use some sort of hand crushing. This method has numerous disadvantages: It cannot disintegrate the coating of the p/t and they float as large flakes on top of the liquid. It is a very tedious process. It does not dissolve the p/t to very small homogeneous particles. Significant part of the p/t material is left behind in the package where the p/t were crushed. Mixing with the liquid is insufficient.

Other prior art dissolvers use ultrasound. Ultrasound methods also have numerous disadvantages. The time to dissolve p/t depends on the p/t size and it can vary from 20 sec to 60 sec. It requires long time and high power ultrasound horn for large p/t which causes the liquid in the cup to heat up, making it unpleasant to drink. The ultrasound can not dissolve many of the different coating materials. As a result, the broken coating material floats on top of the liquid. The ultrasound requires high power to operate. It cannot be operated on batteries and thus is not portable. Furthermore, ultrasound pill dissolving methods are expensive.

Several prior art devices use mechanical means to crush medicines. U.S. Pat. No. 5,531,386 describes a pill pulverizer apparatus which is sized to loosely receive a folded envelope containing the dry medicine to be crushed. A hammer is withdrawn by a motor, thereby compressing a spring. The pill pulverizer automatically detects the insertion of the envelope and then the hammer is released and propelled against the envelope breaking the medicine inside apart in one short blast. The crushed dry medicine may then be poured out of the envelope into a second container where it can be mixed with water. Such a system results in extra waste from needing a second container, and the likely possibility that some of the crushed medicine will remain stuck in the corners of the envelope, resulting in inaccurate dosage for a patient. Additionally, if such a system was used to crush hard-covered liquid-filled gels, the liquid medicine would coat the inside of the envelope and not pour completely into the secondary container, thereby resulting in possibly a more inaccurate patient dosage.

U.S. Pat. No. 5,376,072 describes an apparatus and method for crushing a pill and administering the pill ingredients. A pill is placed in a syringe barrel, and then a syringe plunger is placed into the barrel, and pressed and optionally grinded against the pill to crush it. An inlet/outlet tube is provided on the barrel, so that the plunger may be withdrawn to pull liquid into the barrel for mixing with the crushed medicine. The crushed medicine/liquid mixture may then be plunged out of the inlet/outlet tube. In some embodiments, the entire plunger/barrel crushing mechanism is only good for one crushing due to contamination. In other embodiments, a disposable insert is provided for the barrel and a disposable insert is provided for the plunger.

U.S. Pat. No. 5,067,666 describes a portable pill crusher which has a crushing ram which is normally spring biased away from a crushing area. A cup containing pills for crushing may be placed into the crushing area. An eccentric wheel on a motor forces the ram down into the top opening of the cup and into a relatively slow crushing contact directly with the medicine. Since the ram directly contacts the medicine, it must be cleaned between every use with an alcohol-soaked swab to remove remaining medicine. Additionally, this remaining medicine on the ram may result in inaccurate dosage to patients.

U.S. Pat. No. 6,622,949 describes a portable, solenoid-driven medicine crusher. An outer cup contains dry pills for crushing, and an inner cup is placed within the outer cup to cover the pills. This dual-cup may be placed into the crushing area. A ram is forced down into the top opening of the inner cup by a solenoid, thereby crushing the dry medicine between the inner and the outer cups. The need for a second cup for each crushing results in a system which has extra waste. Additionally, as in all the above systems, liquid is added to the crushed medicine after the medicine has been crushed.

Thus, there is a need for a pill dissolver which must be able to dissolve all kinds and shapes of pills, tablets or caplets. The pill dissolver should be able to dissolve the medicine to small particles, including all the different coating on the p/t. The pill dissolver must be able to convert solid medication to a well mixed liquid, and must be able to complete the whole dissolving cycle quickly—preferably in less than 20 sec. In some applications, the pill dissolver must be portable with an optional battery operation. The pill dissolver should be small in size and low cost, and must reduce waste. The pill dissolver must also provide accurate dosage by not leaving crushed medication behind.

SUMMARY

The invention is a pill dissolver and method of dissolving solid medications using high frequency electromechanical action. The medication is placed in a conical cup, preferably of plastic, and a small amount of liquid is added to cover the medication. The cup is placed in a fixture, and jaws close above the liquid level to seal the cup. A hammer is drawn back and released to crush the medication in the liquid between the hammer and an anvil (or between two hammers) at a rapid repetition rate. Finally, the jaws are opened, more liquid is added, and the dissolved medication may be dispensed.

A pill dissolver includes a first crushing surface, and a second crushing surface positioned to receive a cup between the first crushing surface and the second crushing surface. The pill dissolver also includes pinching jaws operable to pinch a top portion of the cup above the first and second crushing surfaces. The pill dissolver further includes an actuator which creates relative movement and an impact force between the first crushing surface and the second crushing surface.

A method of dissolving a pill is also described. A cup is put within a set of open jaws. At least one pill, capsule, or tablet is dropped into the cup. A first amount of liquid is added to the cup. The jaws are pinched against the cup to seal the first amount of liquid and the at least one pill, capsule, or tablet in a lower portion of the cup. An impact force is created on the lower portion of the cup by reciprocating the first crushing surface relatively against the second crushing surface repeatedly. The jaws are released from the cup, and a second amount of liquid is added to the cup.

Furthermore, a pill dissolving system is also described. The pill dissolving system includes a conical cup and a pill dissolver. The pill dissolver includes an anvil, a hammer positioned to receive the conical cup between the anvil and the hammer, and a fluid doser which can selectively add a desired amount of fluid to the conical cup when the conical cup is positioned between the anvil and the hammer. The pill dissolver also includes pinching jaws operable to pinch a top portion of the conical cup above the anvil and the hammer, and an actuator which reciprocally moves the hammer away from and against the anvil to create an impact force on the conical cup and its contents between the anvil and the hammer while the pinching jaws pinch the top portion of the conical cup.

DETAILED DESCRIPTION

Figure 1:
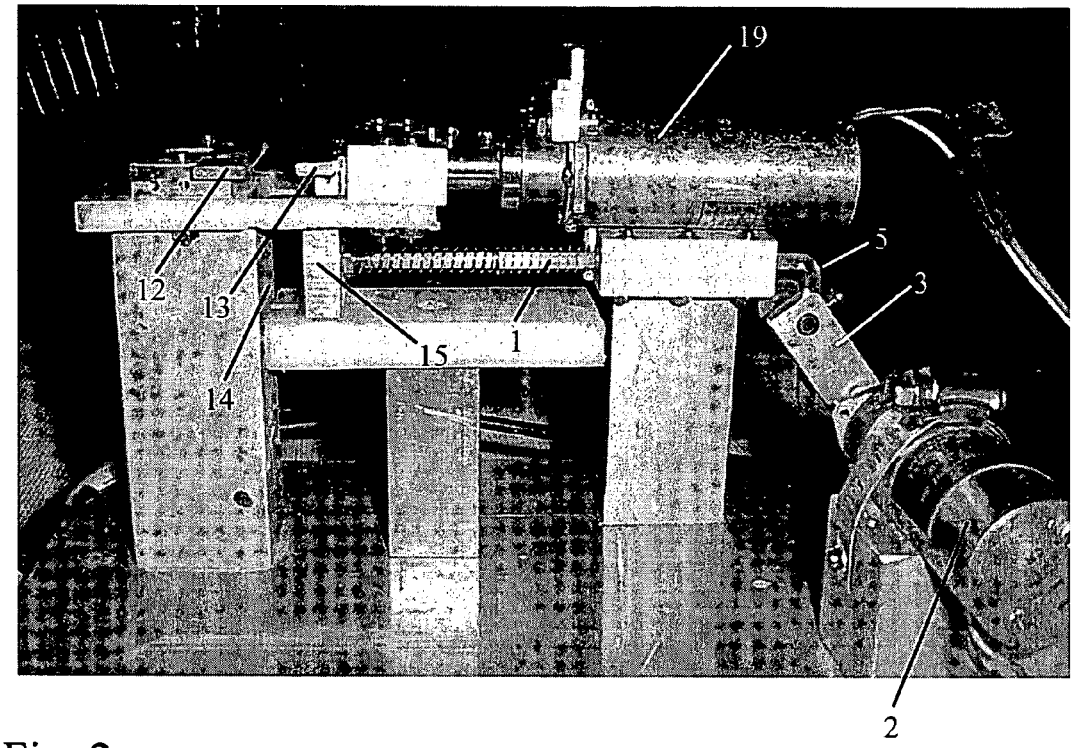
FIG. 1 shows a side view of a first embodiment of the invention
Figure 2:
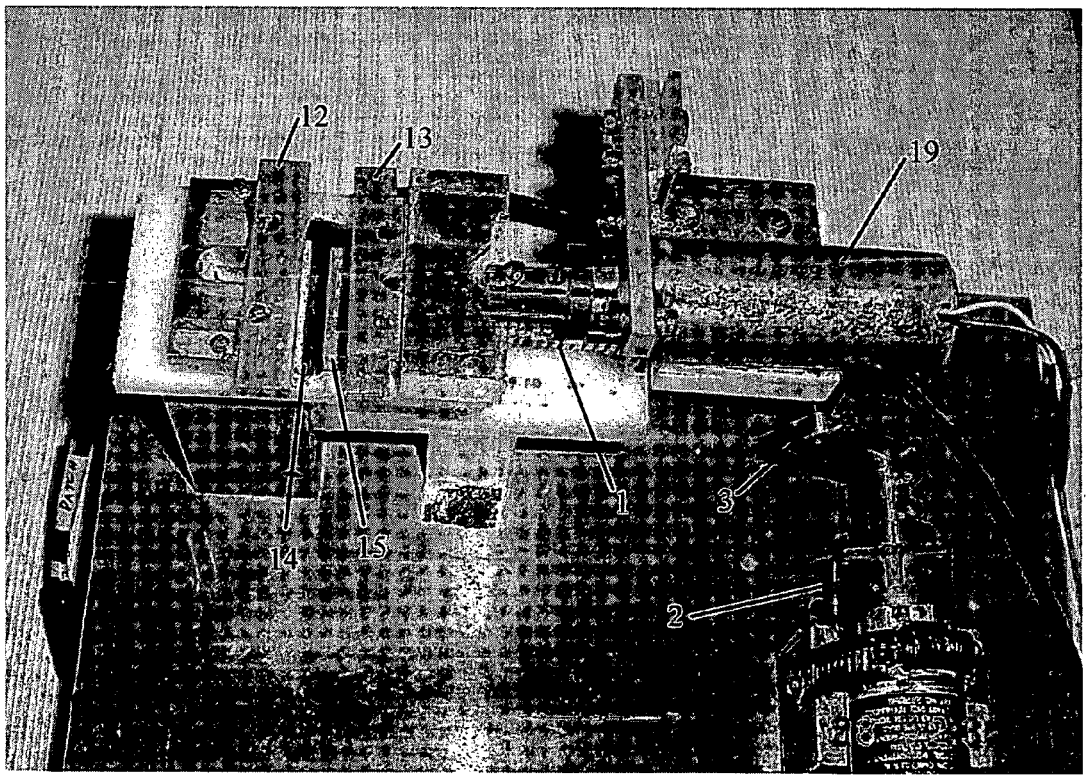
FIG. 2 shows a perspective view of the embodiment of FIG. 1
Figure 3:
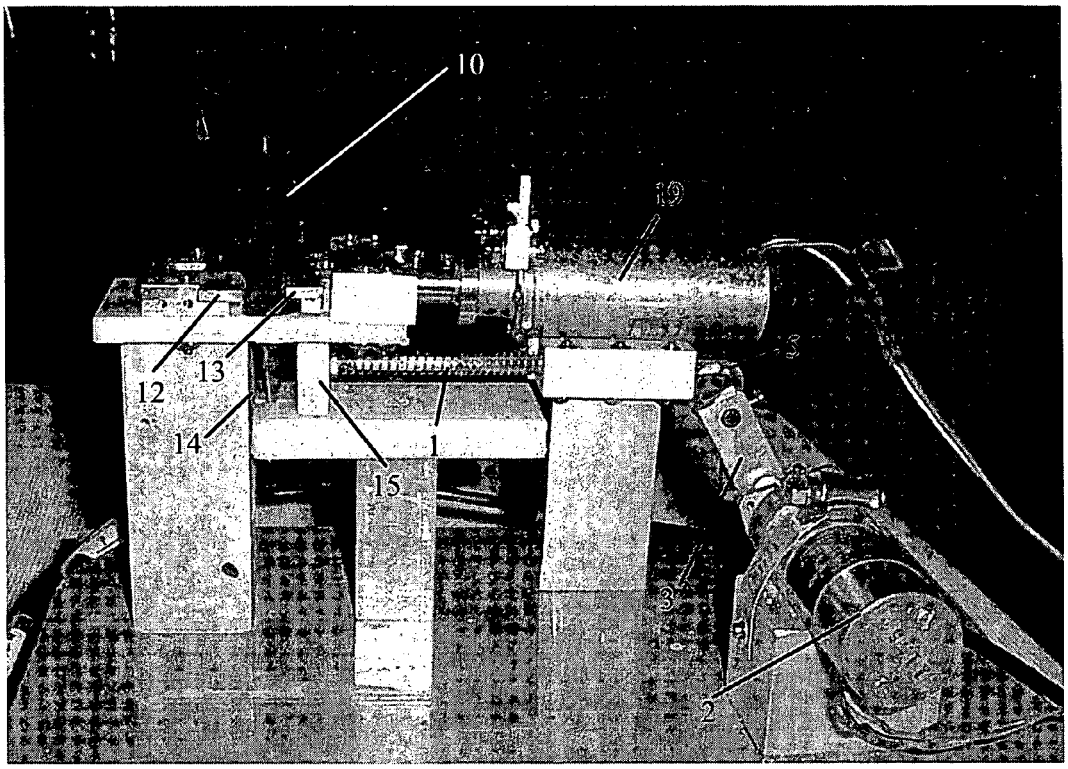
FIG. 3 shows a side view of the first embodiment, with a cup in place

Two embodiments of the invention will be shown and described in detail in this disclosure, although it will be understood by one skilled in the art that additional embodiments are possible within the teachings of the invention.

The two embodiments are the higher-volume institutional model, in which photographs of a prototype version is shown in FIGS. 1-8, which will preferably be portable and battery operated, and a lower-volume home version, shown in FIGS. 9-12. FIGS. 13*a*-13*f* show a schematic of the operation of both versions of the invention.

The immediately following description will be made with reference to the institutional model of FIGS. 1-8, but in most respects it is applicable to both embodiments. The differences in the home version will be discussed in detail below.

Conical Cups

The medicine to be dissolved is placed in a conical cup (10), preferably made of thin, flexible plastic. While paper cups could be used, plastic has the advantages that it does not break down or dissolve under the mechanical action of the apparatus, and its smooth surface does not trap particles of the medicine. Preferably, the cup is approximately 2-3 fluid ounces in capacity, although other sizes could be used.

Using conical shape cups to hold the p/t has numerous advantages:

- The conical shape allows the p/t (11) which is placed inside to drop to a consistent location, regardless of the size of the medicine
- The conical cup can be pinched and when released it will restore to its original shape.
- When the cup is pinched, the p/t is locked in place at the bottom.
- The conical cup has a relatively large opening which makes drinking from it more pleasant and easy. It is also easy to hold.
- Conical cups are easy to manufacture—conical paper cups have been used at drinking fountains for over a century—and inexpensive enough to discard after one use.

In a complete system, the conical cups can be placed on a tray with holes. Or, we can add a cylindrical base into which the cup will be inserted. The cylindrical base can be 1-2 inch tall. It will have grooves in which the cup will be locked into.

The cylindrical base can be made of plastic material or hard paper. The advantage of a cylindrical base is that it will add rigidity and provide an easy way to reform the cup to its original shape after it was pinched by the jaw.

In other embodiments, different shaped cups may be used, provided the different cups are capable of regaining enough shape after being pinched and released to allow more liquid to be added and to allow a patient to drink their medicine from the different shaped cups.

The Hammer and Anvil

The cup (10) is placed between a reciprocating hammer (15) and a metal post or anvil (14). The crushing of the p/t is done by converting the kinetic energy of the fast accelerating "hammer" (15) to an impact energy against the anvil (14).

The hammer (15) is drawn back against a spring (1), preferably a compression spring, by an electrical or electromechanical actuator. Preferably, as shown in FIGS. 1-6, the compression spring is loaded by a DC motor (2) rotating at high RPM.

Figure 4:
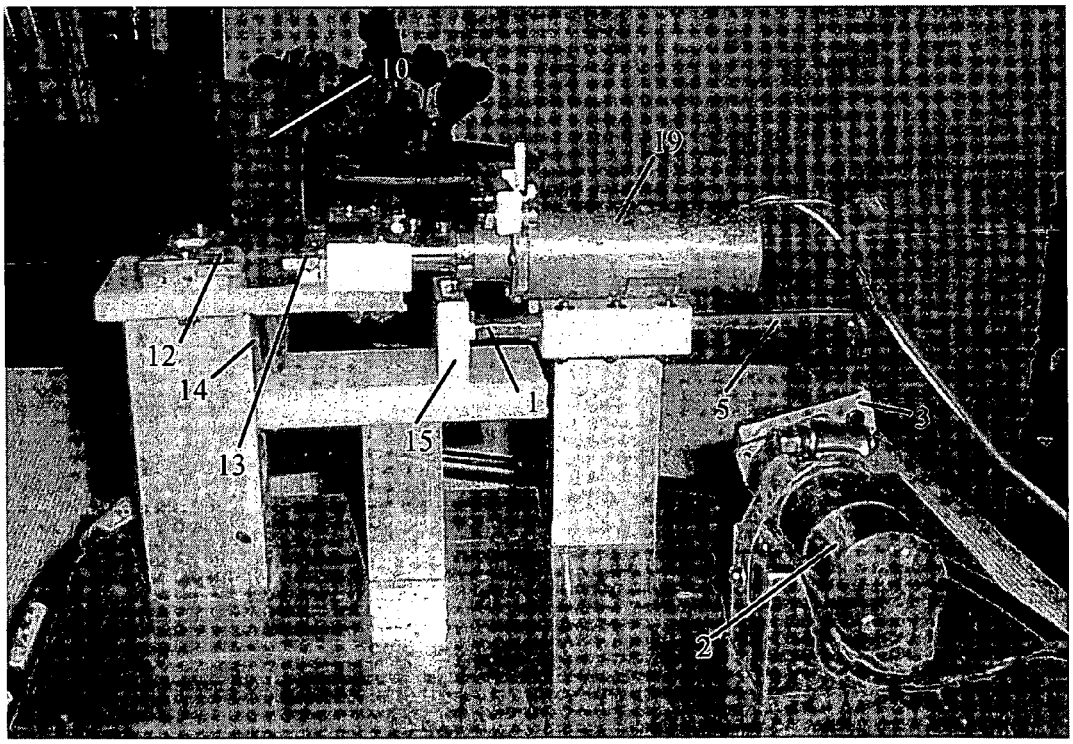
FIG. 4 shows the same view as FIG. 3, but with the hammer drawn back
Figure 5:
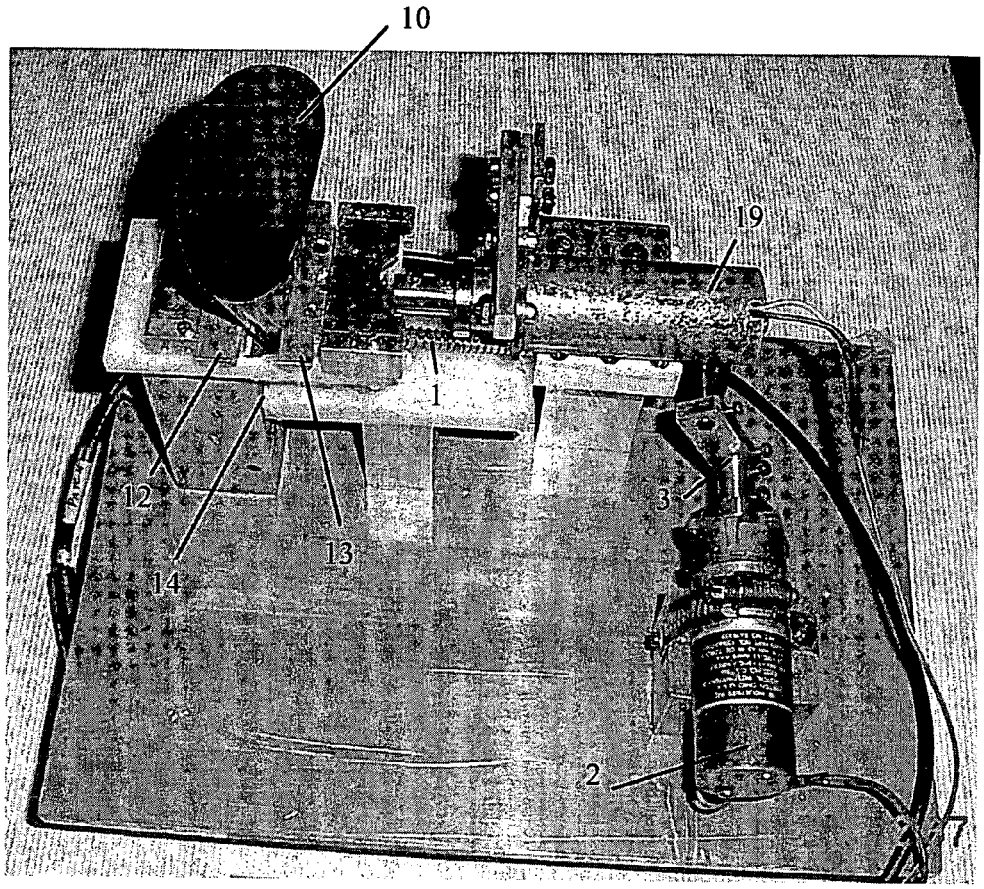
FIG. 5 shows a perspective view as in FIG. 2, with a cup in place and the jaws half closed.
Figure 6:
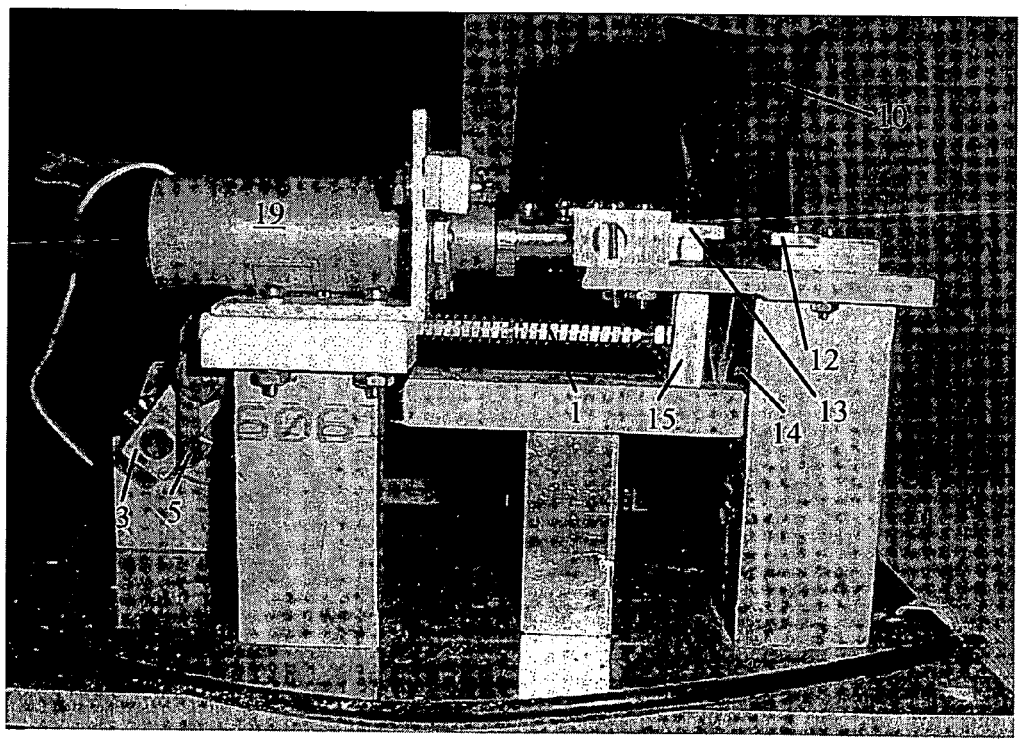
FIG. 6 shows an opposite side view from FIG. 3
Figure 7:
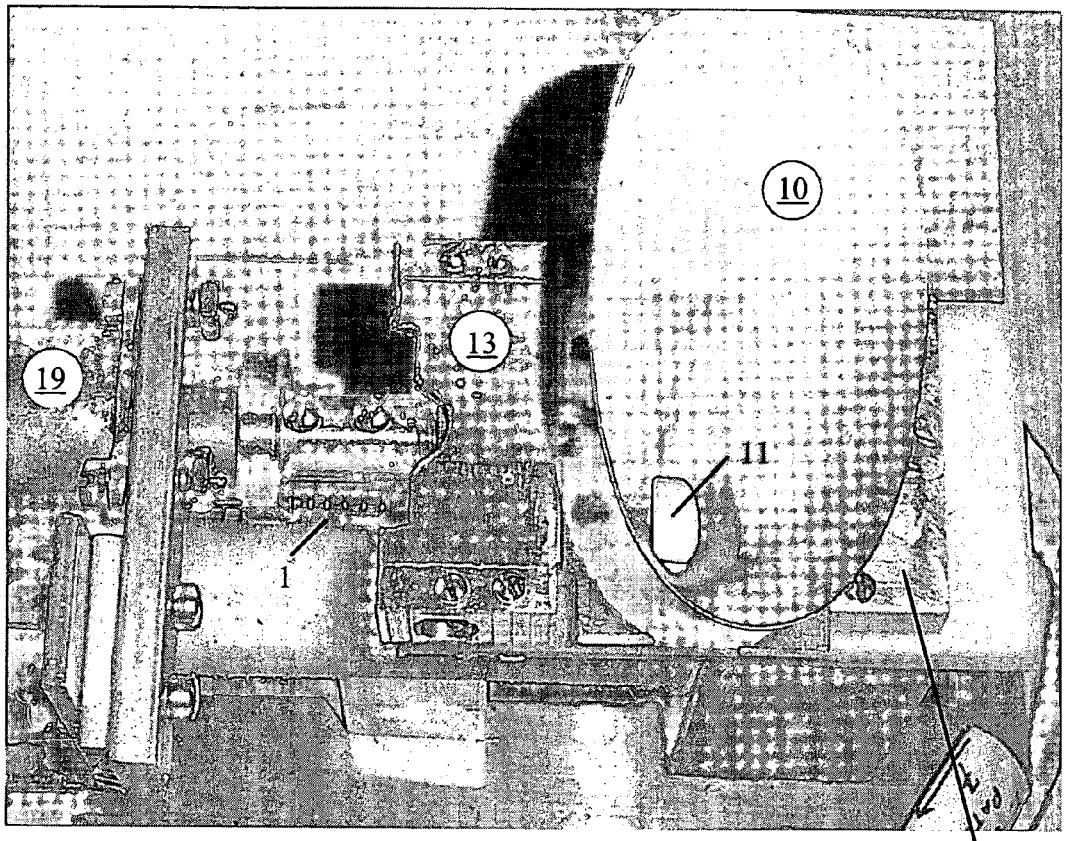
FIG. 7 shows a top detail view of the jaw mechanism and cup, with a pill in the cup
Figure 8:
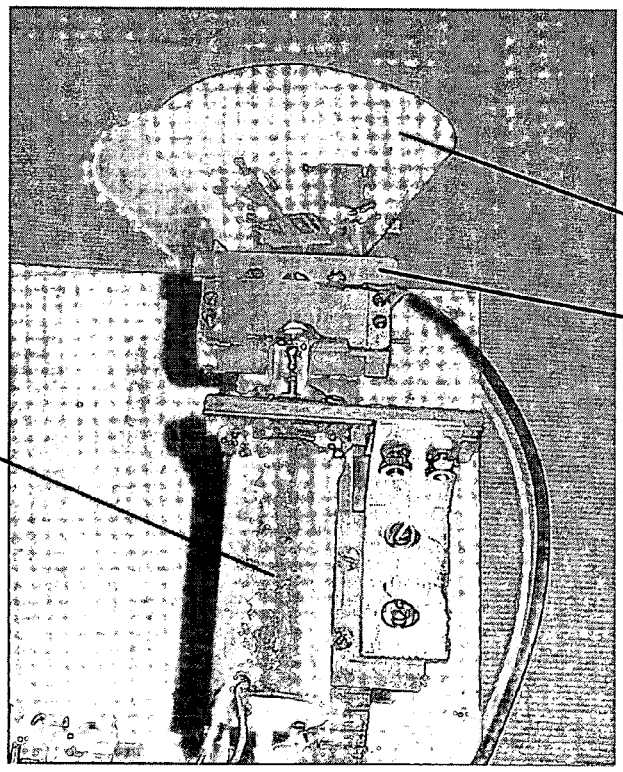
FIG. 8 shows a perspective view of the jaw mechanism, with cup in place, from a different angle than FIG. 7

The spring (1) is compressed to its minimum length and then it is released when the motor (2) completes half a turn, as shown in FIG. 4, by the action of rotating arm (3) pushing on trigger arm (5). As the motor rotates past the point shown in FIG. 4, the trigger arm (5) is released, allowing the spring (1) to accelerate the hammer (15) towards the p/t (11) in the cup (10).

The fast moving hammer (15) hits the bottom of the conical cup (10) against the anvil (14), and converts all its kinetic energy to an impact energy which crushes the p/t (11) inside the cup (10). The motor (2) turns slowly enough that the hammer (15) can hit the bottom of the cup (10) before motor (2) completes the full turn, but quickly enough that the rotating arm (3) can catch the trigger arm (5) as soon as the hammer (15) strikes, pulling it back against the spring (1) for another blow. This compressing and releasing occurs once per each full turn of the motor.

It will be understood that this is just one possible way of rapidly pulling back and applying force to return the hammer, and that others are possible within the teachings of the invention. For example, a tension spring could be used in place of a compression spring, or a solenoid could be used to draw back the hammer in place of the motor.

Preferably, the reciprocating action of the hammer will occur at a rate of approximately five blows per second (5 Hz)—a rotational speed of approximately 300 RPM on the motor in the arrangement shown in the figures would result in a 5 Hz strike rate. In the prototype shown in the figures, the full travel of the hammer is approximately 2.5".

Pinching Jaws

In order to make sure that the crushed particles of the p/t (11) and the small amount of liquid (~5 ml) which is added to the cup (10) will not escape from the cup while it is hit repeatedly by the hammer (15), the conical cup is pinched closed at about 1.5 to 2 inches above the bottom.

One or both of the pinching jaws (12) and (13) are preferably operated by a stepping motor (19) in the institutional embodiment shown in the figures. It is also possible to have the pinching jaws closed and open manually. In other embodiments, the jaws may be opened or closed with a solenoid.

The initial opening of jaws may be made smaller than the cup diameter at the height of the jaws in order to push some of the air out before the pinching of the cup.

Liquid Pump

An automated institutional embodiment of the dissolver will preferably include a liquid pump to add liquid automatically to the cup two times. Schematic FIG. 13*b* illustrates such an optional liquid source (152). The optional liquid source (152) can be a connection to an external water supply line or a liquid holding area within or coupled-to the pill dissolver. A liquid dosing control device (154), such as a liquid pump or a liquid valve, is coupled to the optional liquid source (152). When activated, the liquid dosing control device (154) will allow a desired amount of liquid to pass through line (150) and into the cup (140). On the first time, a small amount of liquid—perhaps 5 ml—is added to the cup before the jaws are closed. On the second time, about 30 ml of liquid is added to the cup after the crushing was completed and the jaws opened.

Crushing the p/t together with the liquid has the following advantages:

It helps breaking and dissolving the coating material, which is often made out of different, more elastic, material than the p/t.

It helps to achieve a well mixed liquidized medication

It speeds up the dissolving process since the liquid helps to transfers the impact, efficiently, from the hammer to all particles

A Description of the Operation of the Invention

The following explanation is made with reference to FIGS. 13*a* through 13*f*.

Figure 13A:
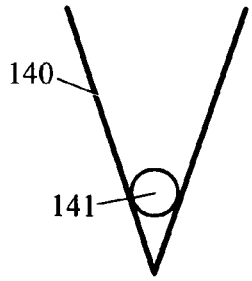
FIGS. 13*a*-13*f* shows the method and apparatus of the invention in schematic form.
Figure 13B:
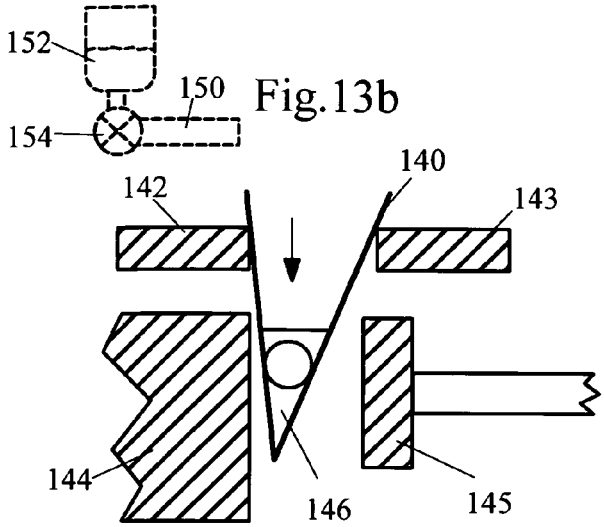

FIG. 13*a:* The p/t (141) is dropped into the cup (140). Because of the conical shape of the cup. (140), the p/t will fall to a determined location in the bottom of the cup.

FIG. 13*b:* The cup (140) is inserted between the jaws (142) and (143), and seats with the p/t between hammer (145) and anvil (144). A small amount of liquid (146) is added, either manually, or via the optional liquid dosing control device 154.

Note that the preceding steps may be accomplished in a different order (the p/t can be dropped in after the cup is seated, the liquid could be added first or after the p/t is put in the cup but before it is placed in the apparatus, etc.). The addition of the liquid is preferably done automatically in an automated version. In a preferred embodiment, a cover (not shown) is closed once the cup is seated with p/t in place.

Figure 13C:
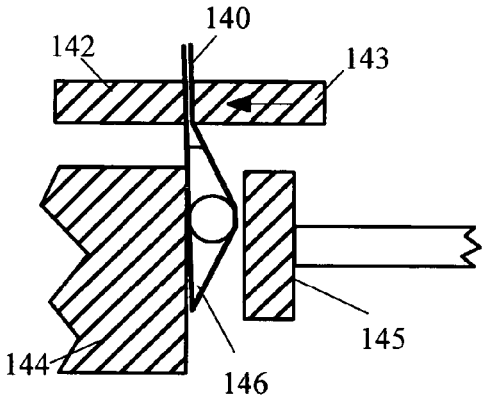

FIG. 13*c:* The jaws (142) and (143) are closed—in the embodiment shown, only one jaw (143) actually moves, although it will be understood that both jaws could be movable.

Figure 13D:
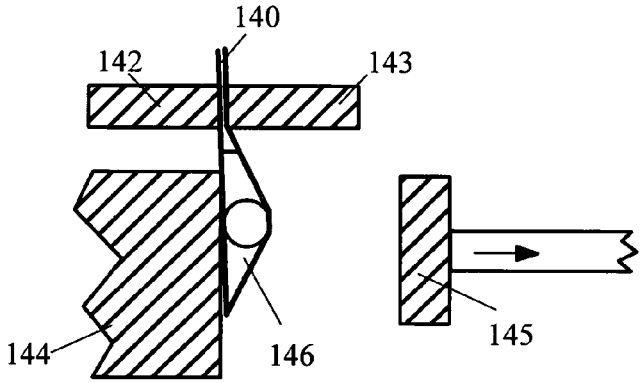

FIG. 13*d:* The actuator (not shown) is turned on, pulling the hammer (145) back against the force of the spring (not shown).

Figure 13E:
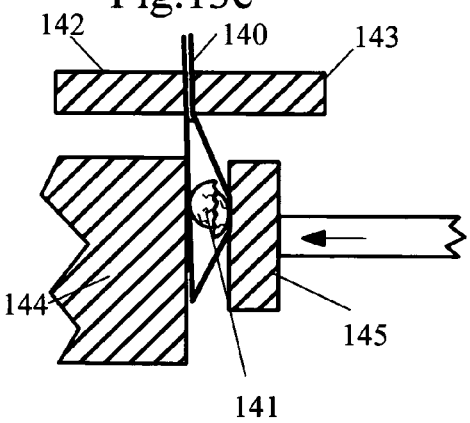

FIG. 13*e:* The hammer (145) is released, and the energy of the spring drives the hammer into the cup (140), crushing the pill (141) against the anvil (144).

Steps 13*d* and 13*e* are repeated, causing the hammer to strike rapidly for 5-10 seconds.

Figure 13F:
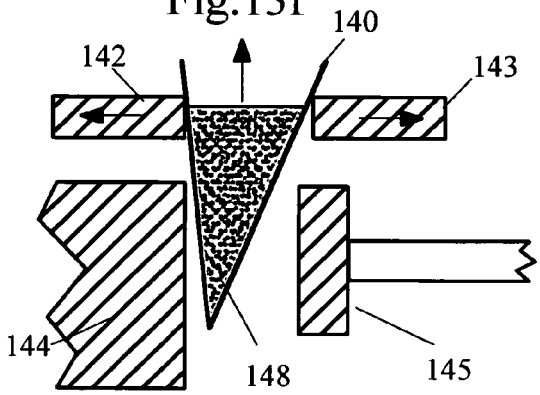

FIG. 13*f:* The jaws (142) and (143) are opened, and additional fluid (~30 ml liquid) is added to the crushed p/t and liquid (148) in the cup (140), which can then be removed.

The nurse or other operator can then cover the cup and put a sticker label on the cup, so that the liquid medicine is ready to administer.

The Semi-Automated Dissolver or Home Version

Figure 9:
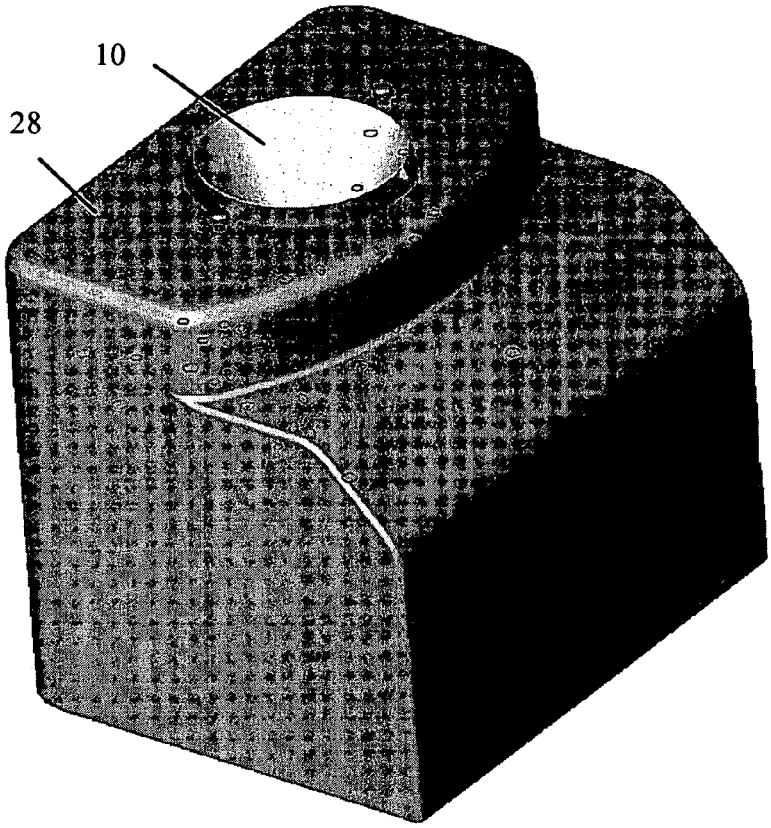
FIG. 9 shows a perspective view of a second embodiment of the invention, with the top open and a cup in place
Figure 10:
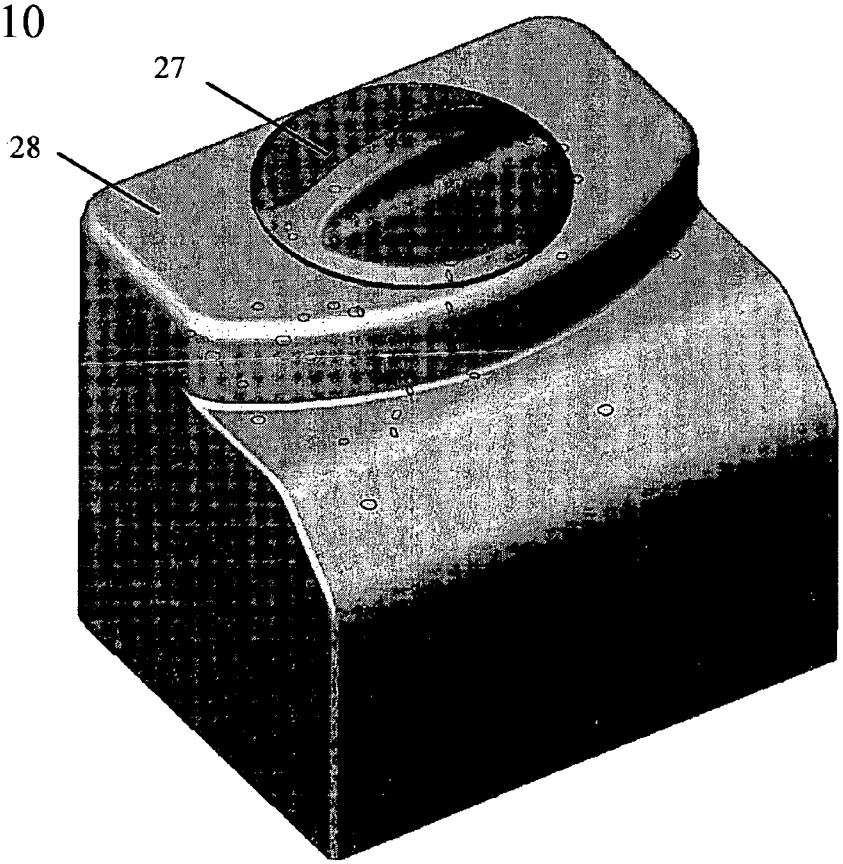
FIG. 10 shows a perspective view of the embodiment of FIG. 9, with the top in place.

The following description refers to the Home Version or semi-automatic embodiment of the dissolver shown in FIGS. 9-12. This version will preferably have the following characteristics:

1. The Pill Dissolver will operate from 110 Volt outlet, instead of operating under battery power.
2. To lower price it will be semi-automatic
3. It may include a dispensing liquid pump
4. It will have only one DC motor to drive the hammer
5. It will use the closing and opening of the lid as the driving mechanism of pinching and releasing of the cup As can be seen in FIGS. 9 and 10, the home version of the pill dissolver is preferably small and compact, enclosed in a watertight case (28). The conical cup (10) is seated on the top of the dissolver, and a cover (27) fits over the cup (10). As will be seen in the cutaway views, FIGS. 11 and 12, the cover (27) both covers the cup and actuates the mechanism of the dissolver.

Figure 11:
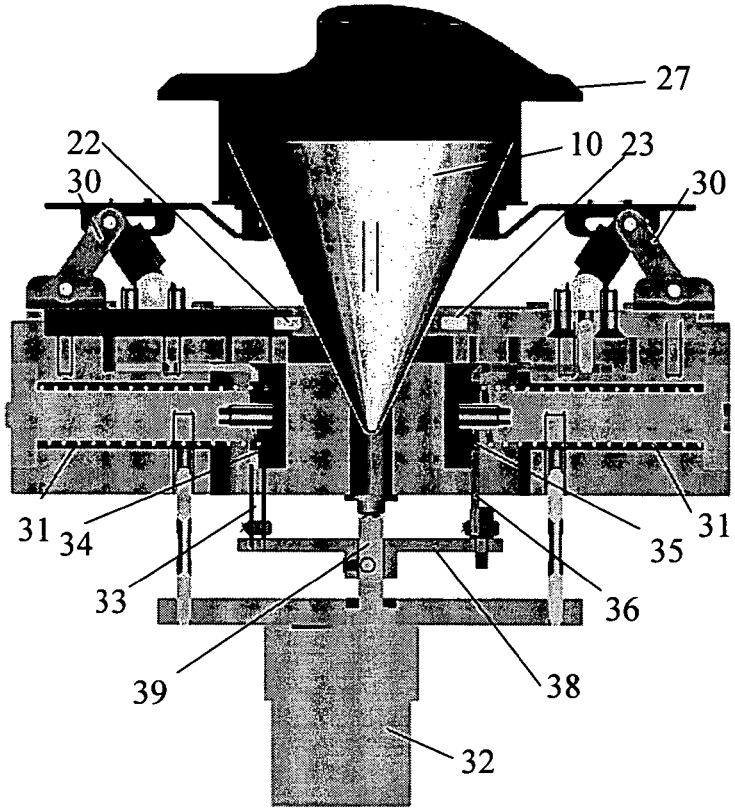
FIG. 11 shows a side cut-away view of the embodiment of FIG. 9, with the jaws open and the cup inserted but not in final position.

Turning now to FIG. 11, it can be seen that when the cup (10) is placed in the dissolver, and the cover (27) put in place, the jaws (22) and (23) are open. The cup is inserted but not in final position. It is pushed to the final position between the jaws by the action of closing the cup. Unlike the powered operation shown in the previous embodiment, the jaws here are operated by linkages (30) to the cover (27), so that when the cover is turned the linkages (30) cause the jaws (22) and (23) to close, as shown in FIG. 11. This drawing is a layout of three drawing one on top of the other. 1. The cup is in its final position. 2. The jaws are closed by the action of rotating the cup 3. One of the two hammers is shown at the fully closed position.

Figure 12:
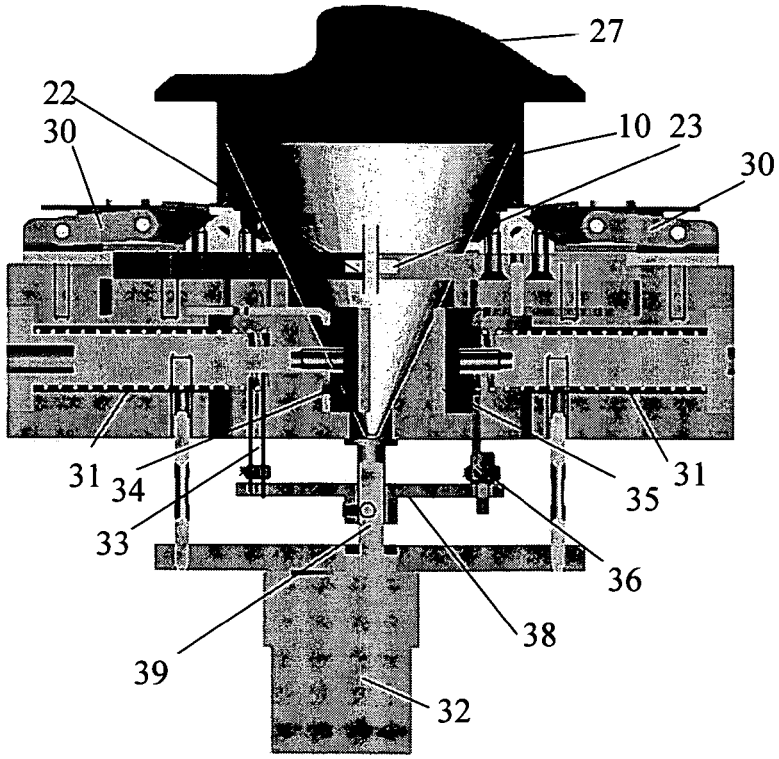
FIG. 12 shows is a composite of three drawings based on the view of FIG. 11

As can be seen in FIGS. 11 and 12, this embodiment shows an alternative to the moving hammer (15) and stationary anvil (14) of the first embodiment of FIGS. 1-9. In this design, two moving hammers (34) and (35) are used, pulled apart by the action of operating arms (33) and (36), respectively, against the action of springs (31). The operating arms are mounted on operating arm or disk (38), which is turned by shaft (39) of motor (32). Operationally, this arrangement works in the same manner as the hammer and anvil of FIGS. 1-9—as the motor (32) turns, shaft (39) and arms (33) and (34) pull the hammers (34) and (35) back, compressing springs (31) until they reach a limit of travel. As the shaft (39) turns further, hammers (34) and (35) are released, striking the p/t in the cup (10) from both sides simultaneously. Of course, the hammer and anvil arrangement of the earlier embodiment could be used here as well, or some variation on either, such as, for example, a first hammer moving with a second hammer stationary, and then the second hammer moving with the first hammer stationary.

One embodiment of the home version of the dissolver might have a fluid pump to dispense liquid into the cup automatically, or the user could add a small amount of liquid as needed before or after putting the cup in the machine.

Operation Procedure of an Embodiment of the Home Version

1. Put conical cup in the open jaws
2. Drop pill in the cup
3. Press the button marked '1' to fill the cup with ~5 ml of liquid, or a first amount of liquid is automatically added prior to pinching the cup.
4. Close lid. Closing the lid will pinch the cup and will trigger the on switch for the motor to run the hammer for 5-10 sec at ~5 Hz
5. Open lid. It will open the jaws. The cup will bounce open.
6. Press the button marked '2' to activate pump to fill the cup with ~30 ml of liquid, or a second amount of liquid is automatically added after opening the jaws.
7. Remove cup. Dissolved medication is ready to drink In a different embodiment the retail dissolver will not include liquid pump and the user will have to add the liquid manually in step 3 and step 6. In still other embodiments, the liquid pump could be replaced with a gravity-fed device having a valve which controls liquid dosage.

In any of the above embodiments, the liquid may be water or a formulated solution.

Accordingly, it is to be understood that the embodiments of the invention herein described are merely illustrative of the application of the principles of the invention. Reference herein to details of the illustrated embodiments is not intended to limit the scope of the claims of the utility application which will be filed based on this provisional application, which themselves will recite those features regarded as essential to the invention.

What is claimed is:

1. A pill crusher, comprising:

a first crushing surface;

a second crushing surface positioned to receive a cup between the first crushing surface and the second crushing surface;

pinching jaws operable to pinch a top portion of the cup above the first and second crushing surfaces; and an actuator which creates relative movement and an impact force between the first crushing surface and the second crushing surface.

2. The pill crusher of claim 1, wherein:

the first crushing surface comprises a stationary anvil;

the second crushing surface comprises a moveable hammer; and the actuator reciprocates the hammer away from and back towards the anvil to create an impact force on the cup received between the first crushing surface and the second crushing surface.

3. The pill crusher of claim 2, wherein the actuator comprises a motor and a linkage coupled to the motor which alternately move the hammer away from the anvil while compressing a compression spring with the hammer, and then release the hammer which is then propelled towards the anvil when the compression spring decompresses.

4. The pill crusher of claim 2, wherein the actuator comprises a motor and a linkage coupled to the motor which alternately move the hammer away from the anvil while stretching a tension spring with the hammer, and then release the hammer which is then pulled towards the anvil when the tension spring unstretches.

5. The pill crusher of claim 2, wherein the actuator comprises a solenoid which may be electrically actuated to reciprocate the hammer away from and towards the anvil.

6. The pill crusher of claim 1, wherein the impact force is created at a rate of approximately five blows per second.

7. The pill crusher of claim 1, wherein:

the first crushing surface comprises a first moveable hammer;

the second crushing surface comprises a second moveable hammer; and the actuator reciprocates the first and second moveable hammers towards each other to create the impact force on the cup received between the first crushing surface and the second crushing surface.

8. The pill crusher of claim 7, wherein the first and second moveable hammers are moving at the same time for at least part of their movement.

9. The pill crusher of claim 7, wherein the first and second moveable hammers move at separate times.

10. The pill crusher of claim 1, wherein the pinching jaws pinch when actuated by a jaw actuator selected from the group consisting of an electrical jaw actuator, an electromechanical jaw actuator; and a mechanical jaw actuator.

11. The pill crusher of claim 10, wherein the mechanical jaw actuator is activated by a cup cover which is removeably installed to cover the cup.

12. The pill crusher of claim 1, wherein the pinching jaws have an initial opening which is smaller than a diameter of the cup at the height of the jaws in order to push some air out of the cup before pinching the cup.

13. The pill crusher of claim 1, further comprising a liquid dosing control device for automatically adding liquid to the cup while the cup is not pinched closed by the pinching jaws.

14. The pill crusher of claim 13, wherein the liquid dosing control device comprises a liquid pump.

15. The pill crusher of claim 13, wherein the liquid dosing control device comprises a liquid valve.

16. The pill crusher of claim 1, further comprising a power supply coupled to the actuator.

17. The pill crusher of claim 1, further comprising a battery coupled to the actuator.

18. A method of dissolving a pill, comprising:

putting a cup within a set of open jaws;

dropping at least one pill, capsule, or tablet into the cup;

adding a first amount of liquid to the cup;

pinching the jaws against the cup to seal the first amount of liquid and the at least one pill, capsule, or tablet in a lower portion of the cup;

creating an impact force on the lower portion of the cup by reciprocating a first crushing surface relatively against a second crushing surface repeatedly;

releasing the jaws from the cup; and adding a second amount of liquid to the cup.

19. The method of claim 18, wherein the liquid is water or a formulated solution.

20. The method of claim 18, wherein adding a first amount of liquid and a second amount of liquid to the cup comprises automatically adding the liquid.

21. The method of claim 18, wherein adding a first amount of liquid and a second amount of liquid to the cup comprises manually adding the liquid.

22. The method of claim 18, wherein pinching the jaws against the cup comprises actuating the jaws against the cup with an electrical or an electro-mechanical actuator.

23. The method of claim 18, wherein pinching the jaws against the cup comprises actuating the jaws against the cup with a mechanical actuator.

24. The method of claim 23, wherein the mechanical actuator comprises a linkage actuated by the closing and opening of a lid for covering the cup, wherein:

closing the lid actuates the linkage to close the jaws against the cup; and opening the lid actuates the linkage to release the jaws from the cup.

25. The method of claim 18, wherein:

the first crushing surface comprises an anvil; and the second crushing surface comprises a hammer which is reciprocated against the anvil.

26. The method of claim 18, wherein creating an impact force on the lower portion of the cup comprises reciprocating the first crushing surface relatively against the second crushing surface repeatedly at a rate of approximately five blows per second.

27. The method of claim 18, further comprising:

removing the cup from the jaws; and administering contents of the cup to a patient.

28. The method of claim 18, wherein the cup comprises a conical cup.

29. The method of claim 28, wherein the conical cup comprises a plastic conical cup.

30. The method of claim 18, wherein the second amount of liquid is greater than the first amount of liquid.

31. A pill dissolving system, comprising:

a conical cup; and a pill dissolver, comprising:

an anvil;

a hammer positioned to receive the conical cup between the anvil and the hammer;

a fluid doser which can selectively add a desired amount of fluid to the conical cup when the conical cup is positioned between the anvil and the hammer;

pinching jaws operable to pinch a top portion of the conical cup above the anvil and the hammer; and an actuator which reciprocally moves the hammer away from and against the anvil to create an impact force on the conical cup and its contents between the anvil and the hammer while the pinching jaws pinch the top portion of the conical cup.

* * * * *